US009512840B2

(12) United States Patent
Obrist et al.

(10) Patent No.: US 9,512,840 B2
(45) Date of Patent: Dec. 6, 2016

(54) SCROLL-TYPE COMPRESSOR AND $CO_2$ VEHICLE AIR CONDITIONING SYSTEM HAVING A SCROLL-TYPE COMPRESSOR

(71) Applicant: Obrist Engineering GmbH, Lustenau (AT)

(72) Inventors: Frank Obrist, Bregenz (AT); Oliver Obrist, Dornbirn (AT); Christian Schmaelzle, Lauterach (AT); Christian Busch, Feldkirch (AT)

(73) Assignee: Obrist Engineering GmbH, Lustenau (AT)

( * ) Notice: Subject to any disclaimer, the term of this patent is extended or adjusted under 35 U.S.C. 154(b) by 60 days.

(21) Appl. No.: 14/282,509

(22) Filed: May 20, 2014

(65) Prior Publication Data

US 2014/0348681 A1 Nov. 27, 2014

(30) Foreign Application Priority Data

May 22, 2013 (EP) ..... 13168729

(51) Int. Cl.
*F04C 29/00* (2006.01)
*F04C 18/02* (2006.01)

(52) U.S. Cl.
CPC ..... *F04C 29/0057* (2013.01); *F04C 18/0207* (2013.01); *F04C 18/0215* (2013.01); (Continued)

(58) Field of Classification Search
USPC ..... 418/55.2, 55.1
See application file for complete search history.

(56) References Cited

U.S. PATENT DOCUMENTS 3,463,091 A 8/1969 Delsuc
3,817,664 A 6/1974 Bennett et al.
(Continued)

FOREIGN PATENT DOCUMENTS

EP 1087142 3/2001
JP 62063189 3/1987
(Continued)

OTHER PUBLICATIONS

European Search Report for EP 13168729, Completed by the European Patent Office on Sep. 17, 2013, 4 Pages.

*Primary Examiner* — Nicholas J Weiss
*Assistant Examiner* — Paul Theide
(74) *Attorney, Agent, or Firm* — Brooks Kushman P.C.

(57) ABSTRACT

A scroll-type compressor for a $CO_2$ vehicle air conditioning system, having a movable displacement spiral which is rotatably connected to an eccentric bearing and which engages into a counterpart spiral such that, between the windings of the displacement spiral and of the counterpart spiral, there are formed chambers which travel radially inward in order to compress the refrigerant and discharge the refrigerant into a pressure chamber, wherein the displacement spiral is arranged on the suction side and the counterpart spiral is arranged on the high-pressure side. The scroll-type compressor is wherein the eccentric bearing is arranged in the displacement chamber between the displacement spiral and the counterpart spiral and has a bearing bushing which is formed integrally with the displacement spiral and the base of which is in alignment with the face side of the windings of the displacement spiral.

10 Claims, 8 Drawing Sheets

(52) U.S. Cl.
CPC ..... *F04C 18/0253* (2013.01); *F04C 18/0284* (2013.01); *F04C 29/0042* (2013.01); *F04C 2210/261* (2013.01)

(56) References Cited

U.S. PATENT DOCUMENTS

| | | | | |
|---|---|---|---|---|
| 3,874,827 | A | 4/1975 | Young | |
| 4,435,137 | A | 3/1984 | Terauchi | |
| 4,610,610 | A | 9/1986 | Blain | |
| 4,927,339 | A | 5/1990 | Riffe et al. | |
| 5,199,280 | A | 4/1993 | Riffe et al. | |
| 6,273,692 | B1 | 8/2001 | Kitano et al. | |
| 2002/0081224 | A1 | 6/2002 | Ueda et al. | |
| 2003/0147763 | A1* | 8/2003 | Sakuda | F04C 18/0215 418/55.1 |
| 2003/0194340 | A1 | 10/2003 | Ni | |
| 2005/0261141 | A1* | 11/2005 | Iso | B82Y 30/00 508/154 |
| 2006/0159580 | A1* | 7/2006 | Matsuhashi | B23D 5/02 418/55.2 |
| 2008/0226483 | A1* | 9/2008 | Iwanami | F01C 21/10 418/97 |
| 2009/0068046 | A1* | 3/2009 | Kishikawa | F04C 18/356 418/55.1 |
| 2009/0098001 | A1 | 4/2009 | Ni | |

FOREIGN PATENT DOCUMENTS

| | | |
|---|---|---|
| JP | 07091384 | 4/1995 |
| JP | 2006144635 | 6/2006 |

* cited by examiner

SCROLL-TYPE COMPRESSOR AND $CO_2$ VEHICLE AIR CONDITIONING SYSTEM HAVING A SCROLL-TYPE COMPRESSOR

CROSS-REFERENCE TO RELATED APPLICATIONS

This application claims priority to EP Patent Application No. EP 13168729.5 filed on May 22, 2013, the disclosure of which is incorporated in its entirety by reference herein.

TECHNICAL FIELD

The invention relates to a scroll-type compressor for a $CO_2$ vehicle air conditioning system, and to a $CO_2$ vehicle air conditioning system having a scroll-type compressor of said type.

BACKGROUND

For the air conditioning of motor vehicles, use is made of non-combustible refrigerants in order to avoid the risk of an explosion in the vehicle interior compartment in the event of a collision. The refrigerants that have hitherto been used have however either already been banned, or are at least regarded as problematic, owing to their high global warming potential. One possible environmentally compatible, non-combustible refrigerant is $CO_2$ (R744), which has already partially replaced the previous refrigerants. $CO_2$ air conditioning systems however operate with high operating pressures, which place particular demands on the strength and sealing action of the system components. The advantage associated with the high operating pressure consists in that, owing to the relatively high density of $CO_2$, a lower volume flow rate is required to impart a relatively high level of refrigeration power.

A scroll-type compressor for a $CO_2$ vehicle air conditioning system is disclosed in JP 2006/144635 A. In general, scroll-type compressors of said type have rotational-speed-regulated electric drives in order to control the refrigeration power of the compressor. In conjunction with vehicle air conditioning systems that operate with conventional, low-pressure refrigerants, scroll-type compressors of simple construction are also known in which power regulation is realized by virtue of the compressor being activated or deactivated.

Accordingly, U.S. Pat. No. 6,273,692 B1 discloses a scroll-type compressor having a mechanical drive which can be connected to the compressor unit by means of an electromagnetic clutch. US 2002/0081224 A1 discloses a variable low-pressure scroll-type compressor which can be deactivated and activated by means of a radial movement of one of the two scroll spirals. Here, the eccentricity between the two scroll spirals is eliminated, which scroll spirals accordingly pass out of engagement in the radial direction.

In the known scroll-type compressors, the sealing action between the compressor spiral and counterpart spiral is a problem that has an effect on performance.

SUMMARY

The invention is based on the object of specifying a scroll-type compressor for a $CO_2$ vehicle air conditioning system, which scroll-type compressor is of simple construction and is improved with regard to the sealing action. The invention is furthermore based on the object of specifying a $CO_2$ vehicle air conditioning system having a scroll-type compressor of said type.

The invention is suitable for rotational-speed-regulated or digitally regulated scroll-type compressors.

The invention has the advantage that tilting moments that act on the compressor spiral are reduced, and thus a uniform surface pressure of the compressor spiral is achieved. The uniform surface pressure has the effect that substantially the same sealing action prevails at all contact points between the two spirals.

For this purpose, it is provided according to the invention that the eccentric bearing is arranged in the displacement chamber between the displacement spiral and the counterpart spiral and has a bearing bushing which is formed integrally with the displacement spiral and the base of which is in alignment with the face side of the windings of the displacement spiral.

The eccentric bearing is arranged in the displacement spiral so as to be recessed in the direction of the pressure chamber, wherein the eccentric bearing is situated at least partially at the level of the windings of the counterpart spiral. The eccentric bearing thus protrudes at least partially into the counterpart spiral. The innermost volume, which in the case of the known low-pressure scroll-type compressors is utilized for the final compression stage, between the displacement spiral and the counterpart spiral is at least partially utilized for accommodating the eccentric bearing. In this way, lever lengths and tilting moments are reduced in an effective manner because the protrusion depth of the eccentric bearing is particularly large.

The invention furthermore has the advantage that the suction side is reliably separated from the high-pressure side because the bearing bushing is formed integrally with the displacement spiral. In this way, no seals are required between the eccentric bearing and the displacement spiral. The bearing bushing participates in the compression process because, firstly, said bearing bushing is situated in the displacement chamber and, secondly, the base of said bearing bushing is aligned with the face side of the windings of the displacement spiral. In this way, the bearing bushing interacts, in the circumferential direction, with the windings of the counterpart spiral and, in the axial direction, with a sealing surface of the counterpart spiral.

Preferred embodiments are specified in the subclaims.

Any tilting moments are further reduced if the displacement spiral has a central recess in which there is at least partially accommodated a counterweight which is connected to the eccentric bearing.

The surface of the eccentric bearing is preferably smaller than the central surface within the innermost winding of the counterpart spiral, specifically such that at least one gas discharge opening formed in the region of the central surface is accessible for the fluid connection to the pressure chamber. In this way, the gas discharge opening is prevented from being covered by the eccentric bearing, which is arranged in a recessed position.

A further improvement in sealing action is achieved if the windings of the displacement spiral and of the counterpart spiral each have lubrication chamfers. Lubricant can collect in the lubrication chamfers, which lubricant improves the sliding properties and reduces local resistance forces, such that a uniform surface pressure and thus a good sealing action prevails between the two spirals. If the lubrication chamfers are formed on both outer edges of in each case the windings of the displacement spiral and of the counterpart spiral, good lubrication is realized in both directions during the reciprocating movement of the displacement spiral.

The lubrication chamfers and/or a radius are/is preferably formed in the corners between the windings and a sealing surface of the displacement spiral. Furthermore, the lubrication chamfers and/or a radius may be formed in the corners between the windings and a sealing surface of the counterpart spiral. The lubrication chamfers or radii in the corners preferably interact with the lubrication chamfers on both outer edges of in each case the windings of the displacement spiral and of the counterpart spiral. In this way, the sealing action in the region of the respective gas chamber or gas pocket, which is formed by the radial contact between the displacement spiral and the counterpart spiral, is improved.

The sealing action can be improved if an accommodating space, which is closed off with respect to the suction side, for the eccentric bearing is fluidically connected to the pressure chamber, and a rear wall of the displacement spiral can be acted on with a surface pressure.

It has been found that a relatively small eccentricity is sufficient for adequate compression of the refrigerant. For this purpose, the distance between the central point of the counterpart spiral and the central point of the displacement spiral may be at most 1.5 mm, in particular at most 1.2 mm, in particular at most 1.0 mm, in particular at most 0.8 mm, in particular at most 0.6 mm, in particular at most 0.4 mm, in particular at most 0.2 mm. The lower limit may be 0.1 mm. It is preferable for the counterpart spiral to have a winding angle of 660° to 720°, in particular of 680° to 700°, whereby adequate compression of the refrigerant is achieved. The volume of the pressure chamber is preferably greater by a factor of 5-7, in particular by a factor of 6, than the suction volume per revolution of the displacement spiral, whereby gas pulsations are reduced in an effective manner.

The invention will be explained in more detail with reference to the appended schematic drawings and on the basis of exemplary embodiments.

DETAILED DESCRIPTION

Figure 1:
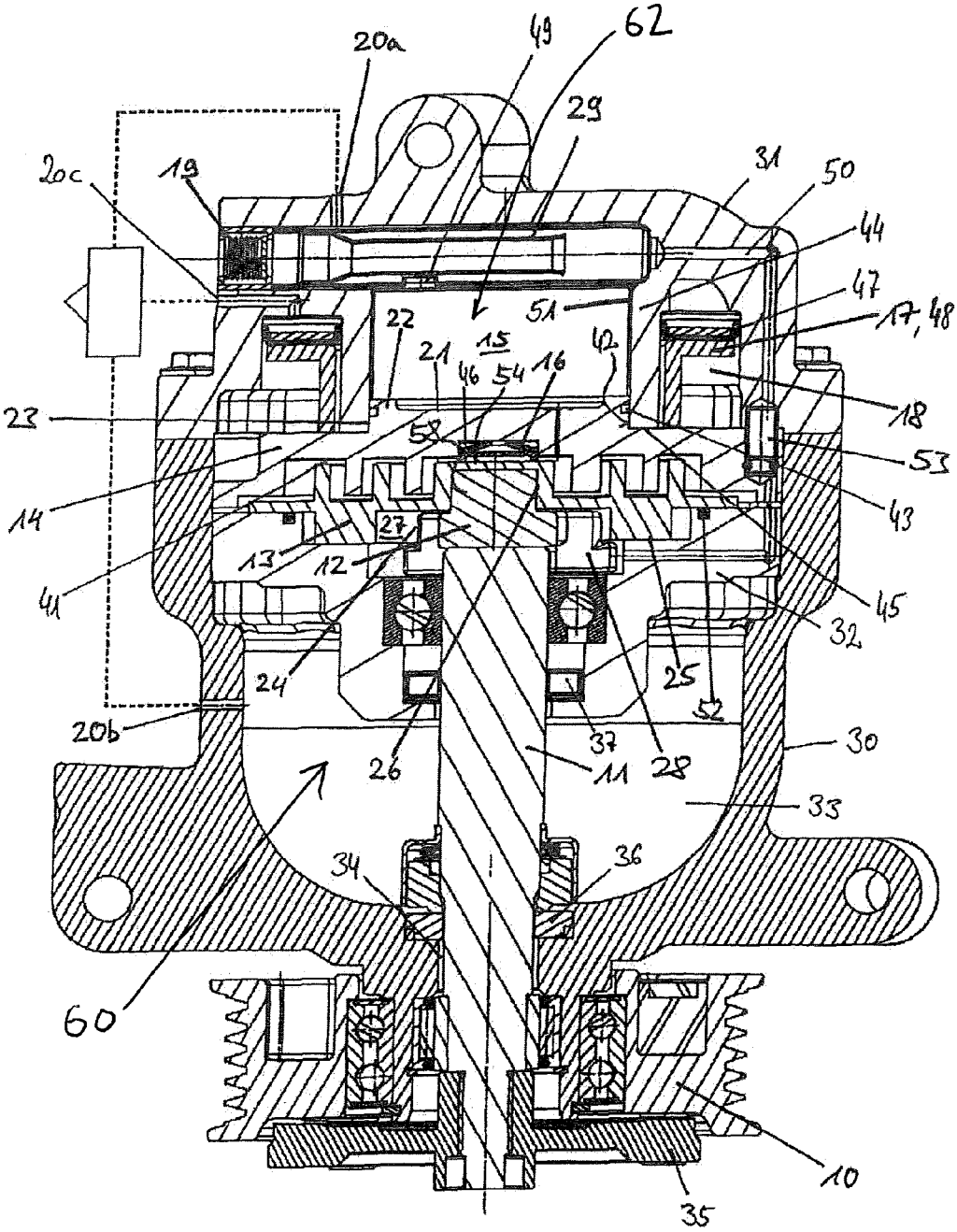
FIG. 1 shows a longitudinal section through a scroll-type compressor as per one exemplary embodiment according to the invention.
Figure 2:
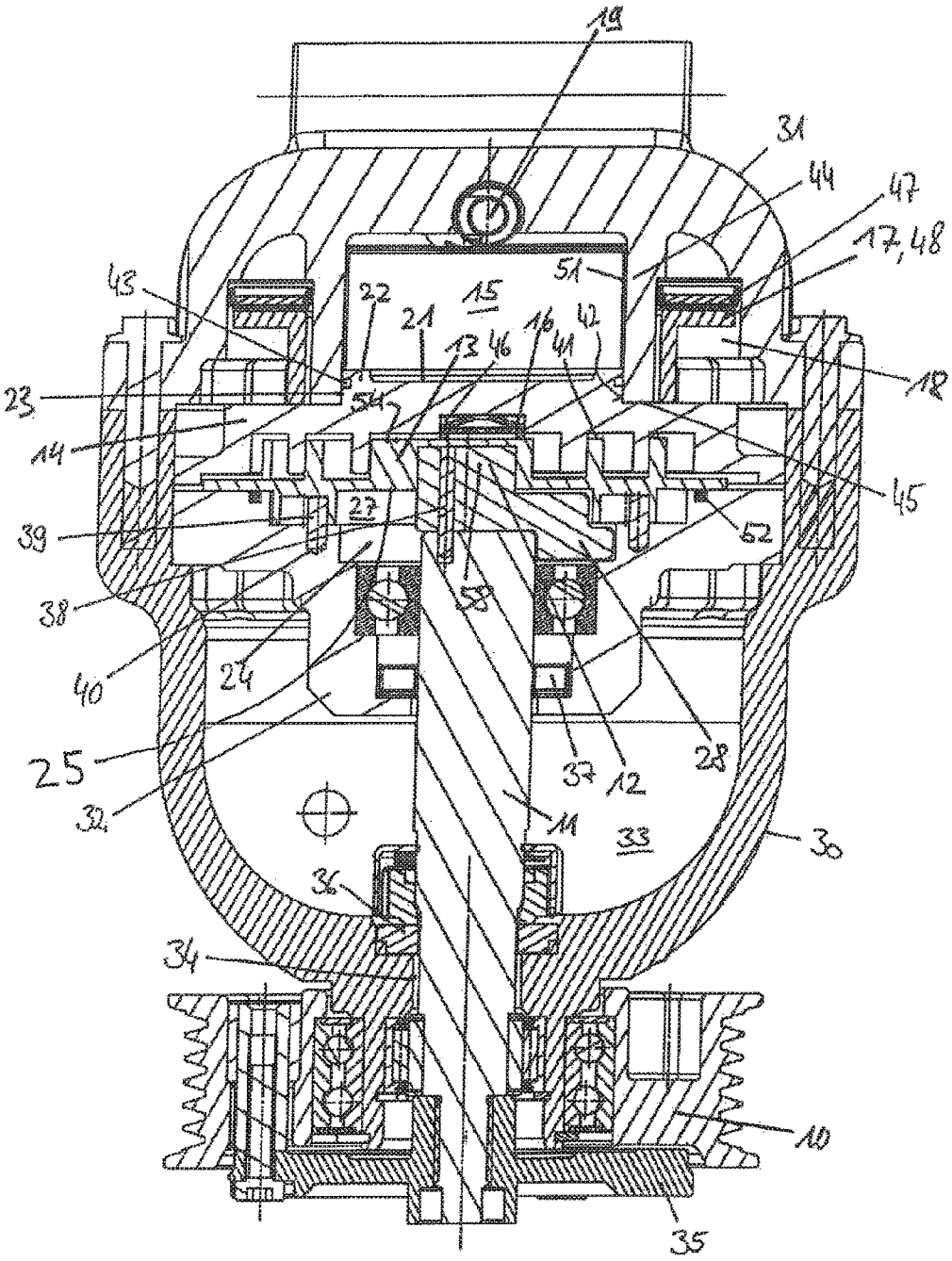
FIG. 2 shows a further longitudinal section through the scroll-type compressor as per FIG. 1, illustrating the construction of the eccentric bearing.

The scroll-type compressor described in detail below is designed for use in a $CO_2$ vehicle air conditioning system, which typically comprises a gas cooler, an internal heat exchanger, a throttle, an evaporator and a compressor. Such systems are designed for maximum pressures of over 100 bar. The compressor is a scroll-type compressor, also referred to as a spiral-type compressor. As illustrated in FIGS. 1 and 2, the scroll-type compressor has a mechanical drive 10 in the form of a belt pulley. The belt pulley may, during use, be connected to an electric motor or to an internal combustion engine.

The scroll-type compressor furthermore comprises a housing 30 with a housing cover 31 which closes off the high-pressure side of the compressor and which is screwed to the housing 30. In the housing 30 there is arranged a housing intermediate wall 32 which delimits a suction chamber 33. In the housing base 34 there is formed a passage opening through which a drive shaft 11 extends. That shaft end which is arranged outside the housing 30 is connected rotationally conjointly to a driver 35 which engages into the belt pulley rotatably mounted on the housing 30, such that a torque can be transmitted from the belt pulley to the drive shaft 11. The drive shaft 11 is rotatably mounted at one side in the housing base 34 and at the other side in the housing intermediate wall 32. The drive shaft 11 is sealed with respect to the housing base 34 by means of a first shaft seal 36 and with respect to the housing intermediate wall 32 by means of a second shaft seal 37.

The drive shaft 11 transmits the torque to a compressor unit, which is constructed as follows.

The compressor unit comprises a movable displacement spiral 13 and a counterpart spiral 14. The displacement spiral 13 and the counterpart spiral 14 engage into one another. The counterpart spiral 14 is fixed in the circumferential direction and in the radial direction. The movable displacement spiral 13, which is coupled to the drive shaft 11, describes a circular path, such that, in a manner known per se, said movement causes multiple gas pockets or gas chambers to be generated which travel radially inward between the displacement spiral 13 and the counterpart spiral 14. By means of said orbiting movement, refrigerant vapor is drawn into the opened gas chamber at the outside and is compressed by way of the further spiral movement and the associated reduction in size of the gas chamber. The refrigerant vapor is compressed in linearly progressive fashion from radially outside to radially inside, and is discharged, at the center of the counterpart spiral 14, into a pressure chamber 15.

For the orbiting movement of the displacement spiral 13, there is provided an eccentric bearing 12 which is connected to the drive shaft by means of an eccentric pin 38 (see FIG. 2). The eccentric bearing 12 and the displacement spiral 13 are arranged eccentrically with respect to the counterpart spiral 14. The gas chambers are separated from one another in pressure-tight fashion by abutment of the displacement spiral 13 against the counterpart spiral 14. The radial surface pressure between the displacement spiral 13 and the counterpart spiral 14 is set by means of the eccentricity.

Figure 6:
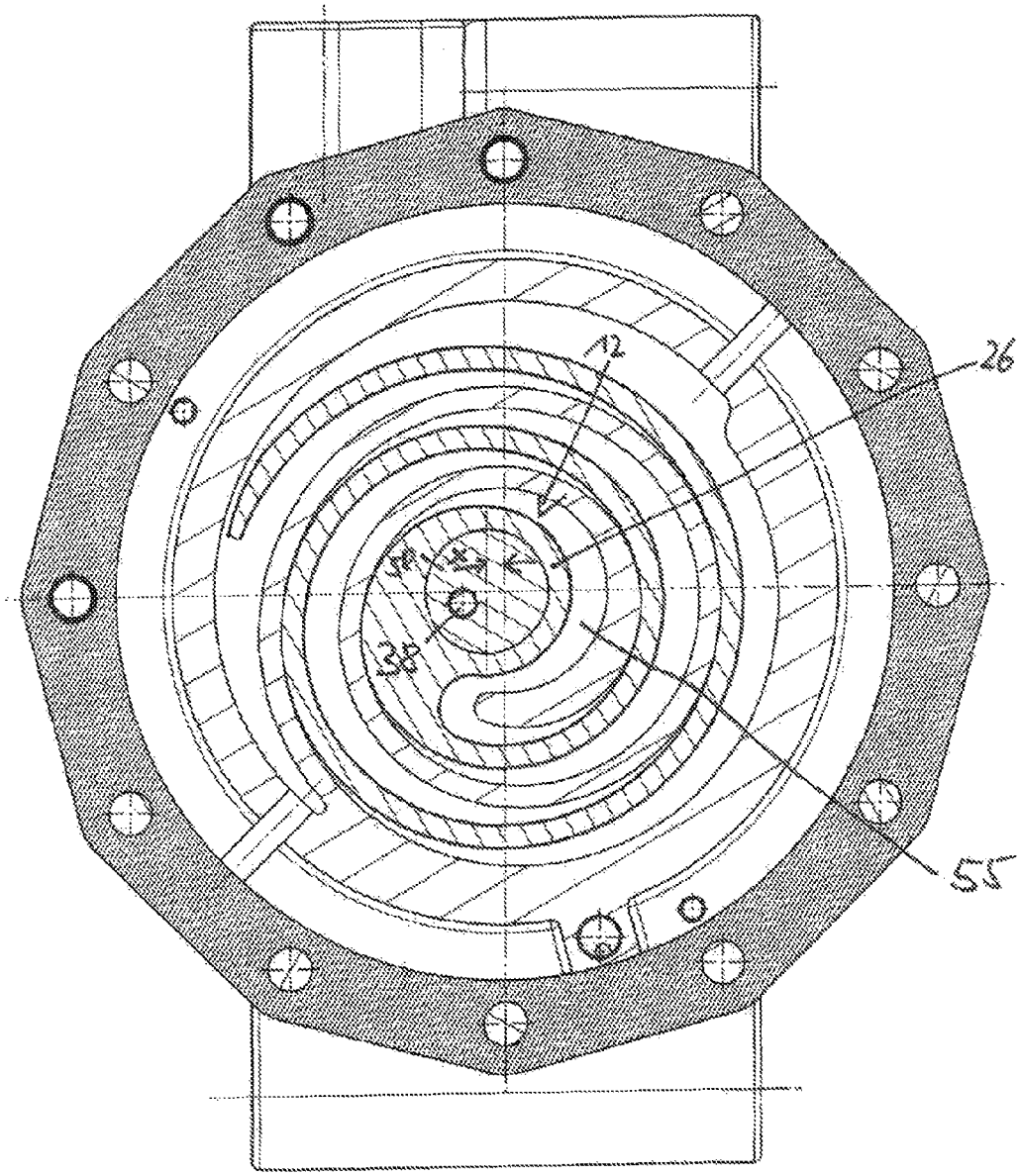
FIG. 6 shows a cross section through a compressor as per FIG. 1.

The eccentricity results from the distance x between the central point of the counterpart spiral and the central point of the displacement spiral (see FIG. 6). The distance x may preferably lie in a range from 0.1 mm to 1.5 mm, in particular from 0.1 mm to 1.0 mm, in particular from 0.1 mm to 0.8 mm, in particular from 0.1 mm to 0.6 mm, in particular from 0.1 mm to 0.4 mm, in particular from 0.1 mm to 0.2 mm.

A rotational movement of the displacement spiral is prevented by means of multiple guide pins 39 which, as illustrated in FIG. 2, are fastened in the intermediate wall 32.

The guide pins 39 engage into corresponding guide bores 40 that are formed in the displacement spiral 13. A counterweight 28 is connected, preferably integrally, to the eccentric bearing 12 in order to compensate for the imbalance arising from the orbiting movement of the displacement spiral 13.

As can be clearly seen in FIGS. 1 to 5, the eccentric bearing 12 is arranged in the displacement spiral 13 so as to be recessed in the direction of the pressure chamber 15. The eccentric bearing 12 is thus situated at at least partially at the level of the windings of the counterpart spiral 14. In this way, the eccentric bearing 12 is arranged in the displacement chamber between the displacement spiral 13 and the counterpart spiral 14.

The eccentric bearing 12 has a journal 58 which is arranged rotatably in a bearing bushing 26. The bearing bushing 26 is formed integrally, or in one piece, with the displacement spiral 13. The bearing bushing 26 and the journal 58 may be composed of the same material, for example bronze.

The bearing bushing 26 and thus also the journal 58 are arranged at the same level as the windings of the two spirals 13, 14 and thus protrude into the counterpart spiral 14. In this way, the outer wall of the bearing bushing 26 forms a part of the winding of the displacement spiral 13 and interacts with the counterpart spiral 14 for the compression of the gas. The axial sealing is realized by means of the base 58 of the bearing bushing 26, which base is in alignment with the face surface of the windings. The face surface and the base 58 are oriented parallel to the sealing surface 59 of the counterpart spiral 14 and seal against said sealing surface in the axial direction (see FIG. 4).

The construction of the eccentric bearing 12 is shown in cross section in FIG. 6. The winding of the displacement spiral 13 widens toward the center. The widened inner part of the displacement spiral 13 receives the journal 58 and integrally forms the bearing bushing 26 in which the journal 58 is rotatably seated.

The surface of the eccentric bearing 12 is smaller than the central surface 55 within the innermost winding of the counterpart spiral 14. The surface of the eccentric bearing 12 corresponds to the surface of the base 54 of the bearing bushing 26. It is achieved in this way that a gas discharge opening (not illustrated) formed in the region of the central surface 55 is accessible for the fluid connection to the pressure chamber 15.

Figure 7:
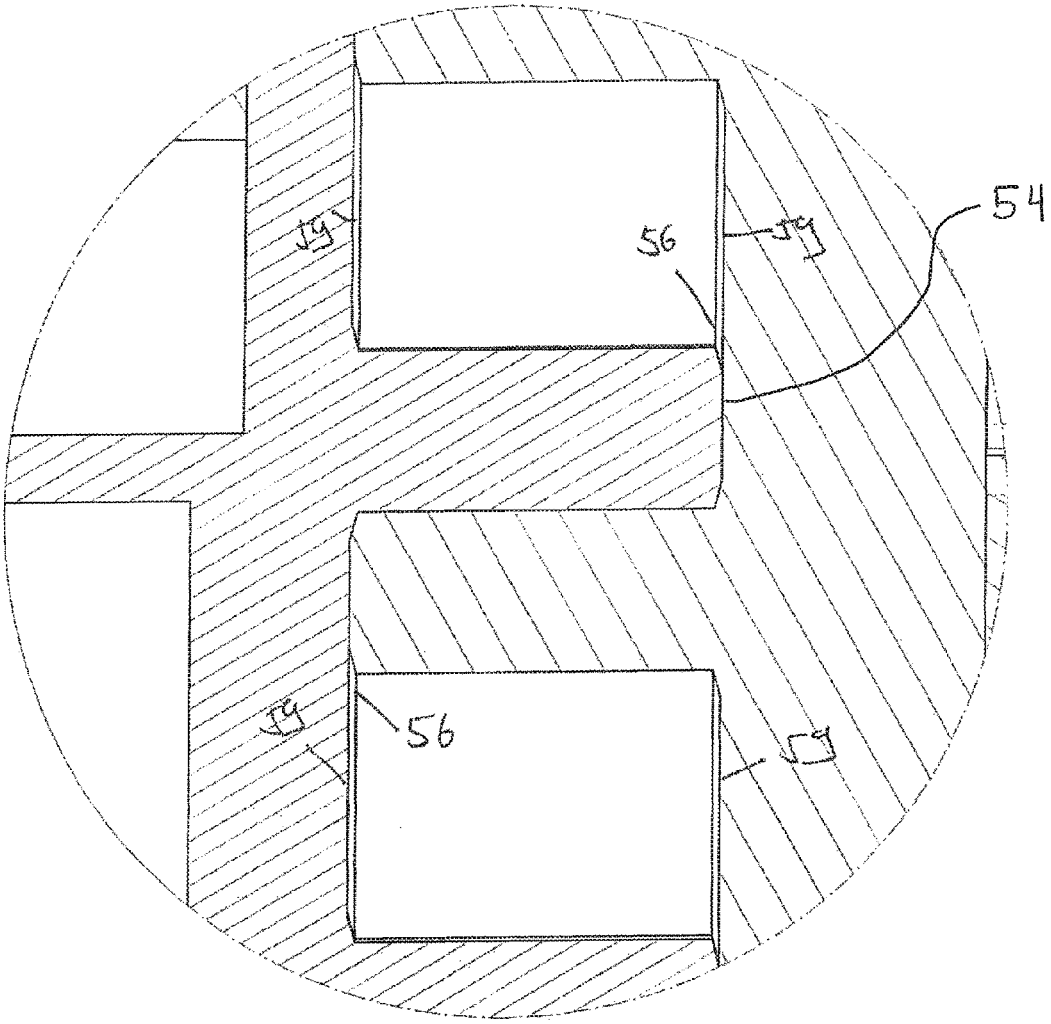
FIG. 7 shows a detail view of the lubrication chamfers.
Figure 8:
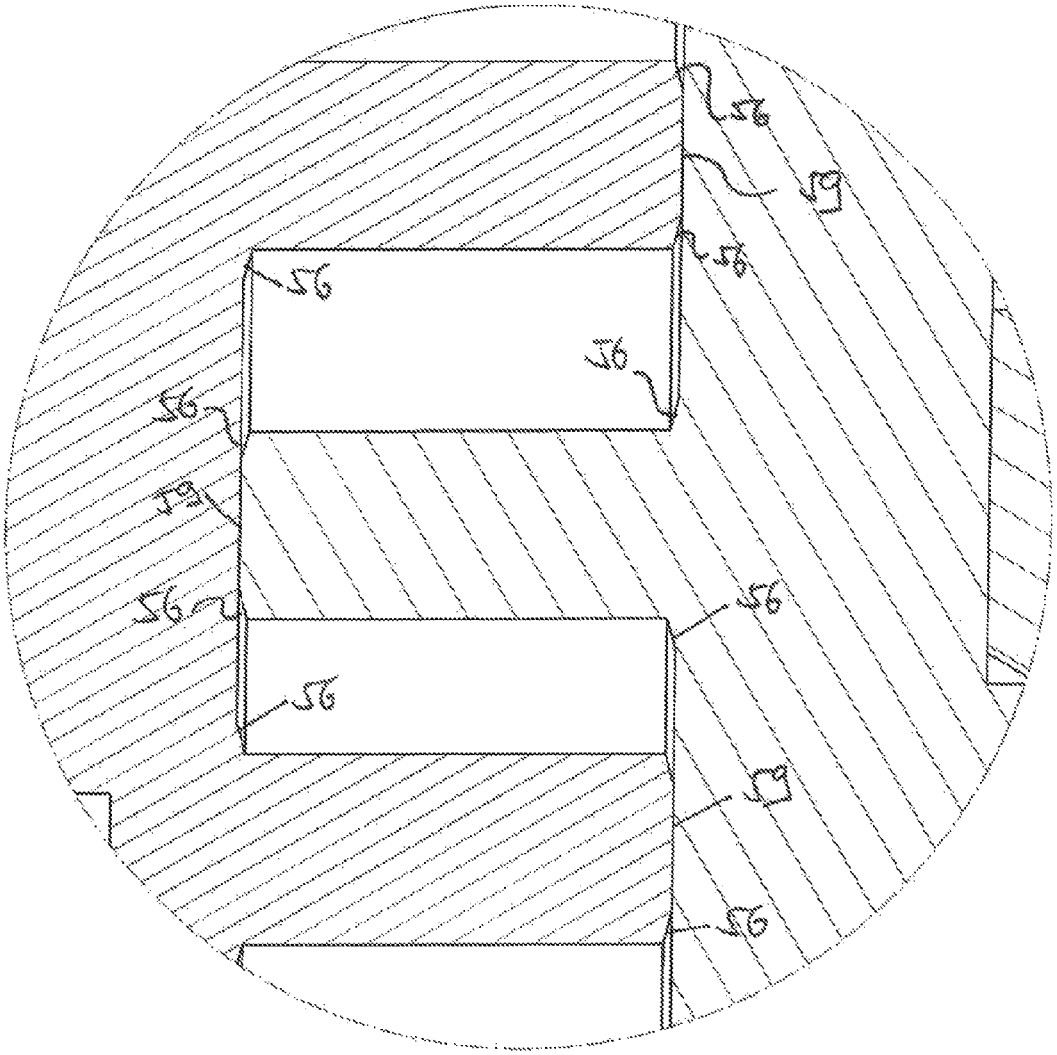
FIG. 8 shows a detail view of the lubrication champers as per FIG. 7, at a different point on the windings.

FIGS. 7 and 8 show different lubrication chamfers 56 that are formed on the outer edges of the windings. The outer edges delimit, on both sides, the respective face surface of the windings of the displacement spiral 13 and of the counterpart spiral 14. The face surface seals against the sealing surface 59 of the respective spiral 13, 14.

Opposite the outer edges, that is to say at the root of the respective winding, corners are formed between the sealing surface 59 and the respective winding. Said corners have lubrication chamfers 56 are of complementary form to the lubrication chamfers 56 on the outer edges of the windings. Here, the complementary lubrication chamfers 56 may have the same angles. It is also possible for the lubrication chamfers 56 in the corners to have a shallower angle than the lubrication chamfers 56 on the outer edges.

Figure 9:
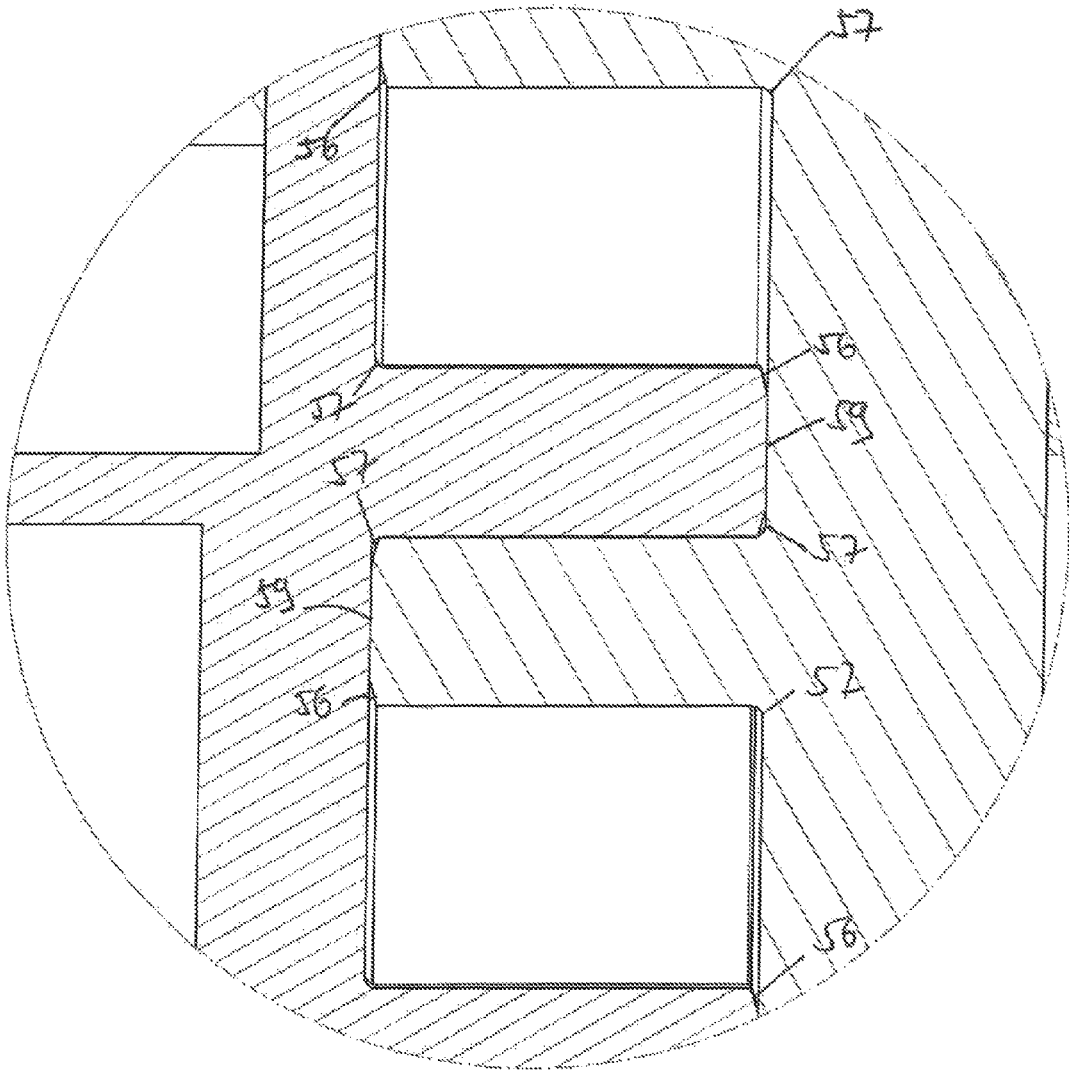
FIG. 9 shows a detail view of the corners that are formed with radii.

Instead of the lubrication chamfers 56 the corners may have radii 57 which are of such a size that they receive the associated lubrication chamfers 56 on the outer edges (see FIG. 9).

Figure 3:
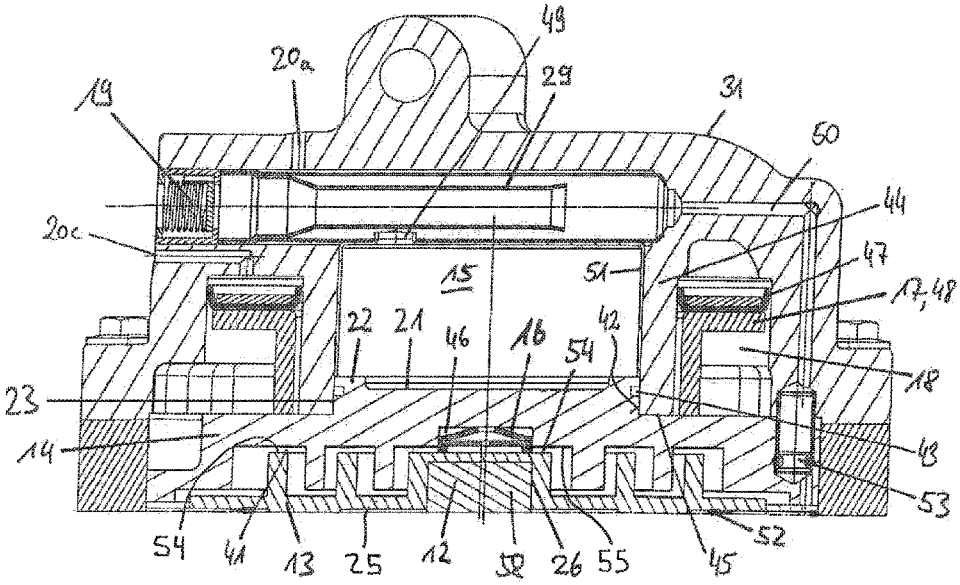
FIG. 3 shows a detail view of the scroll-type compressor as per FIG. 1, in the region of the housing cover.

The scroll-type compressor illustrated in FIGS. 1 and 2 does not have a clutch. To nevertheless be able to vary the power of the compressor, the scroll-type compressor can be activated and deactivated (digital switching). It is provided for this purpose that the counterpart spiral 14 can move in alternating fashion in an axial direction, that is to say in a direction parallel to the drive shaft 11. The displacement spiral 13 is fixed in the axial direction. In this way, the counterpart spiral 14 can be lifted from the displacement spiral 13 in the axial direction, as illustrated in FIGS. 1 to 3. In said open position, a pressure equalization gap 41 is formed between the displacement spiral 13 and the counterpart spiral 14, which pressure equalization gap connects the gas chambers, which are separated from one another in the radial direction, between the displacement spiral 13 and the counterpart spiral 14. This can be clearly seen from FIG. 3. Compressed gas from the chambers arranged further to the inside flows radially outward through said pressure equalization gap 41, whereby pressure equalization occurs. The power of the scroll-type compressor is thereby reduced to 0 or at least approximately to 0.

The axial guidance required for the axial mobility of the counterpart spiral 14 is realized by means of the pressure chamber 15, which furthermore dampens gas pulsations. The pressure chamber 15 thus has a dual function:

It is positioned downstream of the counterpart spiral in the flow direction and is fluidically connected to said counterpart spiral by the outlet (not illustrated) of the counterpart spiral 14. The outlet is not arranged exactly at the central point of the counterpart spiral 14 but rather is situated eccentrically in the region of the innermost chamber between the displacement spiral 13 and the counterpart spiral 14. It is achieved in this way that the outlet is not covered by the bearing bushing 26 of the eccentric bearing 12, and the fully compressed vapor can be discharged into the pressure chamber 15.

For the axial guidance of the counterpart spiral 14, the pressure chamber 15 forms, on the axial end facing toward the counterpart spiral 14, an inner sliding surface 42. The sliding surface 42 is machined and seals against the counterpart spiral 14. The rear wall 21 of the counterpart spiral 14 forms the base of the pressure chamber 15. The counterpart spiral 14 thus terminates directly at the pressure chamber 15. The rear wall 21 furthermore has a flange 22, in particular an annular flange 22, which bears against the sliding surface 42 of the pressure chamber 15. The flange 22 serves as an axial guide for the counterpart spiral 14 in the pressure chamber 15. On the outer circumference of the flange 22 there is formed a groove with a sealing means, for example a sealing ring 43. The pressure chamber 15 is delimited by a circumferential wall 44 which forms a stop 45 and which delimits the axial movement of the counterpart spiral 14.

The pressure chamber 15 is provided in the housing cover 31. This facilitates the installation of the axially movable counterpart spiral 14. Furthermore, said pressure chamber has a rotationally symmetrical cross section.

Figure 4:
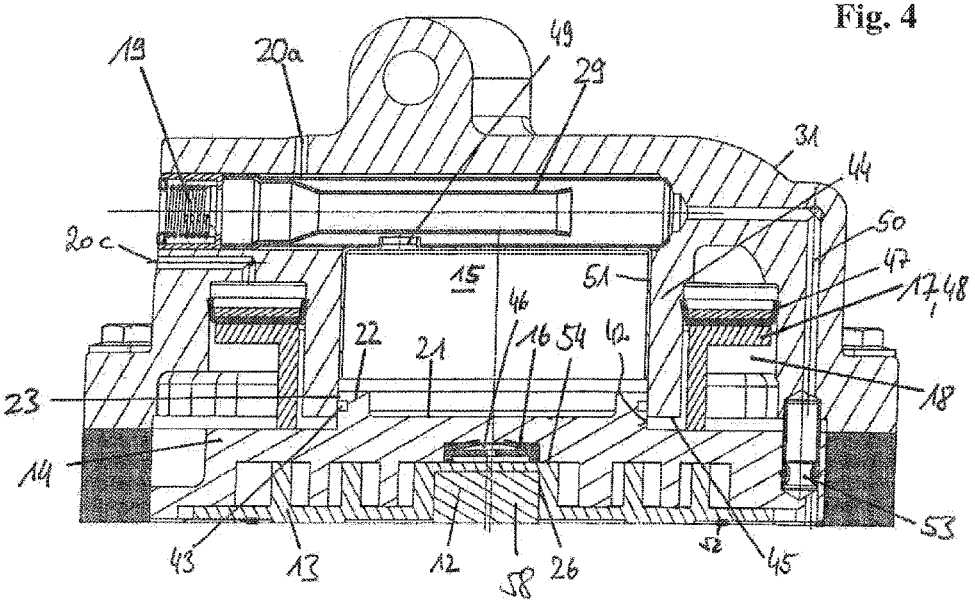
FIG. 4 shows a detail view as in FIG. 3, wherein the compressor is in the closed position.

Oppositely directed axial forces are required for the alternating movement of the counterpart spiral 14 between the open position (FIG. 3) and the closed position (FIG. 4). The axial force that moves the counterpart spiral 14 into the open position (FIG. 3) and thus releases the counterpart spiral 14 from the displacement spiral 13 (axial release force) is generated by a spring 16 that is arranged between the displacement spiral 13 and the counterpart spiral 14. The spring 16 may for example be in the form of a plate spring. In the closed position as per FIG. 4, the spring 16 is preloaded and forces the counterpart spiral 14 and the displacement spiral 13 apart.

As can be clearly seen in FIGS. 3 and 4, the spring 16 is arranged opposite the pressure chamber 15. For this purpose, there is provided in the counterpart spiral 14 a central recess 46 in which the spring 16 is arranged. The spring 16 is supported on the displacement spiral 13. For this purpose, it is provided that the bearing bushing 26 of the eccentric bearing 12 is arranged in a recessed manner in the displacement spiral 13. Here, the bearing bushing 26 protrudes into the counterpart spiral 14 and projects into the counterpart spiral 14. The base of the bearing bushing 26, on which base the spring 16 is supported, is situated at the same level as the inner edges of the windings of the displacement spiral 13. This can be clearly seen from FIG. 3 (open position). In the closed position as per FIG. 4, the base of the bearing bushing 26 thus bears against the counterpart spiral 14 and seals off the innermost gas chamber between the displacement spiral 13 and the counterpart spiral 14.

To move the counterpart spiral 14 from the open position illustrated in FIG. 3 into the closed position shown in FIG. 4, a piston 17, in particular an annular piston 17, is provided which is displaceable coaxially with respect to the longitudinal axis of the counterpart spiral 14. Instead of the annular piston 17, it is also possible for multiple cylindrical pistons to be provided which are arranged on the circumference of the counterpart spiral 14. The annular piston 17 engages on the rear wall 21 of the counterpart spiral 14 and exerts a closing force on said rear wall, which closing force acts counter to the spring force of the spring 16.

As can be seen in FIGS. 1 to 4, the piston 17 engages on the counterpart spiral 14 adjacent to the pressure chamber 15. The piston 17 is thus arranged outside the pressure chamber 15, or generally off-center. For the fluid connection between the counterpart spiral 14 and the pressure chamber 15, it is thus possible for a simple outlet opening to be formed (not illustrated) in the counterpart spiral 14.

The annular piston 17 has a pressure ring 47 that is connected to a base 48 of the piston. The piston base 48 is mounted in an axially displaceable and pressure-tight manner in an axial guide 18. The axial guide 18 is in the form of an annular chamber. For the actuation of the annular piston 17, the annular chamber is connected to a supply port 20*c*. As illustrated in FIG. 1, the supply port 20*c* is connected to a ⅔ directional valve, which in turn is connected to a high-pressure port 20*a* and to a suction-pressure port 20*b*, such that the annular chamber can be charged alternately with high pressure or suction pressure. In this way, the counterpart spiral 14 can be moved back and forth in alternating fashion between the open position or the closed position. Here, the annular piston 17 acts substantially only counter to the spring force of the spring 16, because the pressure which prevails in the pressure chamber 15 and which acts on the counterpart spiral 14 is at least partially compensated by the pressure that acts between the counterpart spiral 14 and the displacement spiral 13 during the compression. Furthermore, only relatively small lifting travels are required in order to set the pressure equalization gap 41. Lifting travels of approximately 0.3 to 0.7 mm, in particular a lifting travel of approximately 0.5 mm, are for example adequate.

Power regulation of the scroll-type compressor is realized by activation and deactivation of the compressor power, specifically by changing the frequency of the cyclic or alternating movement of the counterpart spiral 14.

The compressed gas that is collected in the pressure chamber 15 flows out of the pressure chamber 15 through an outlet 49 into an oil separator 29, which in the present case is in the form of a cyclone separator. The compressed gas flows through the oil separator 29 and a check valve 19 into the circuit of the air-conditioning system. The check valve 19, which prevents a back flow of the compressed gas into the deactivated scroll-type compressor, is designed for example for pressure differences from 0.5 to 1 bar.

The sealing of the displacement spiral 13 against the counterpart spiral 14 in the axial direction is assisted by virtue of a rear wall 25 of the displacement spiral being acted on with high pressure. For this purpose, an accommodating space 24, also referred to as backpressure space (FIG. 1), in which a part of the counterweight 28 and the eccentric bearing 12 are arranged is fluidically connected to the high-pressure side. The accommodating space 24 is delimited by the rear wall 25 of the compressor spiral 13 and by the housing intermediate wall 32.

The accommodating space 24 is separated from the suction space 33 in a fluid-tight manner by the second shaft seal 37 described in the introduction. A sealing and slide ring 52 is arranged between the displacement spiral 13 and the housing intermediate wall 32 and seals off the accommodating space 24 with respect to the high-pressure side. The sealing and slide ring 52 is seated in an annular groove in the housing intermediate wall 32. A gap (not illustrated) is formed between the housing intermediate wall 32 and the displacement spiral 13. The displacement spiral 13 is thus supported in the axial direction not directly on the housing intermediate wall 32 but rather on the sealing and slide ring 52, and slides on the latter. For this purpose, the sealing and slide ring 52 projects out of the annular groove and seals off the gap. The gap may be approximately 0.2 mm to 0.5 mm wide.

For the connection to the high-pressure side, a line 50 connects the oil separator 29 to the accommodating space 24. Said line extends through the housing cover 31, through the counterpart spiral 14 and through the intermediate wall 32. Between the oil separator 29 and the accommodating space 24, specifically between the counterpart spiral 14 and the housing cover 31, there is arranged a pressure reducer 53 which ensures that a pressure difference of approximately 10%-20% prevails between the high-pressure side and the accommodating space 24. It is achieved in this way that, in the closed position, the axial surface pressure between the displacement spiral 13 and the counterpart spiral 14, and thus the axial sealing action, is increased.

From a thermal aspect, the scroll-type compressor illustrated in FIG. 1 is optimized such that undesired heating of the refrigerant vapor on the suction side 60 is reduced. For this purpose, the pressure chamber 15 is encapsulated (see FIG. 4). The pressure chamber 15 is otherwise free from fixtures. For example, the pressure chamber may have an internal jacket 51, composed in particular of high-grade steel or rust-resistant steel. The internal jacket 51 exhibits lower thermal conductivity than aluminum. The thermal insulation of the oil separator 29 additionally reduces the heating of the refrigerant vapor on the suction side 60. Here, too, the thermal insulation is realized by means of an encapsulation, for example by means of an internal jacket composed of high-grade steel or rust-resistant steel, which surrounds the cyclone separator. The pressure reducer 53 is also insulated by means of an encapsulation with an internal jacket composed of high-grade steel or rust-resistant steel.

In this way, it is possible for the housing cover 31 to be manufactured for example from aluminum, without there being the risk of excessive heat transfer from the high-pressure side 62 to the suction side 60.

Figure 5:
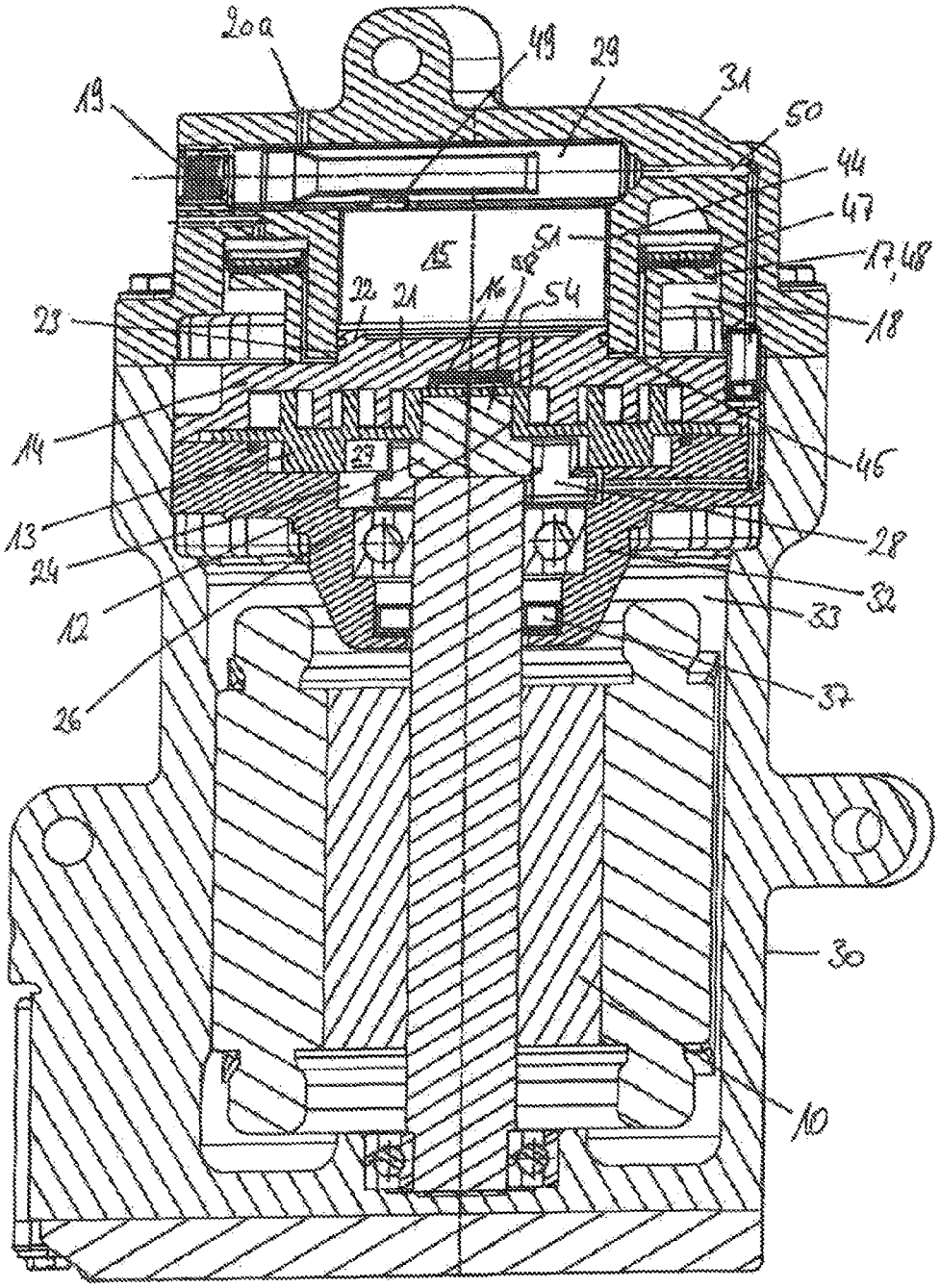
FIG. 5 shows a longitudinal section through a compressor as per a further exemplary embodiment according to the invention, having an electric drive with constant or fixed rotational speed.

The only difference between the scroll-type compressor as per FIG. 5 and the scroll-type compressor as per FIG. 1 consists in that, instead of the mechanical drive, use is made of an electric drive with constant rotational speed, that is to say rotational speed that does not vary with time. Reference is otherwise made to the statements made in conjunction with the mechanically driven scroll-type compressor.

LIST OF REFERENCE SIGNS

10 Drive
11 Drive shaft
12 Eccentric position
13 Displacement spiral
14 Counterpart spiral
15 Pressure chamber
16 Spring
17 Piston/annular piston
18 Piston guide
19 Check valve
20*a* High-pressure port
20*b* Suction-pressure port
20*c* Supply port
21 Rear wall of counterpart spiral
22 Flange
23 Inner wall
24 Accommodating space
25 Rear wall of displacement spiral
26 Bearing bushing
27 Recess
28 Counterweight
29 Oil separator
30 Weight
31 Housing cover
32 Housing intermediate wall
33 Suction chamber
34 Housing base
35 Driver
36 First shaft seal
37 Second shaft seal
38 Eccentric pin
39 Guide pins
40 Guide bores
41 Pressure equalization gap
42 Sliding surface
43 Sealing ring
44 Wall
45 Stop
46 Central recess
47 Pressure ring
48 Piston base
49 Outlet
50 Line
51 Internal jacket
52 Slide and sealing ring
53 Pressure reducer

What is claimed is:

1. A scroll compressor for a $CO_2$ air conditioning system of a vehicle, the scroll compressor comprising:

a housing;

a stationary spiral disposed within the housing and including first windings;

a movable displacement spiral disposed within the housing and defining a central recess, the movable displacement spiral including second windings and engaging with the stationary spiral to form a displacement chamber defined between the stationary spiral and the movable displacement spiral, wherein the first and second windings are interleaved to define a plurality of sub-chambers within the displacement chamber that compress refrigerant and discharge refrigerant into a pressure chamber when the movable spiral orbits relative to the stationary spiral;

a bearing bushing formed with the movable displacement spiral and extending into the displacement chamber such that a face of the bushing is coplanar with a face side of the second windings;

an eccentric bearing including a journal disposed within the bearing bushing and configured to orbit the movable displacement spiral, and a counterweight at least partially accommodated within the central recess and connected to the eccentric bearing.

2. The scroll compressor as claimed claim 1, wherein the eccentric bearing is smaller than a central surface within an innermost winding of the stationary spiral, such that at least one gas discharge opening formed in a region of the central surface is accessible for fluid connection to the pressure chamber.

3. The scroll compressor as claimed in claim 1, wherein the windings of the movable displacement spiral and of the stationary spiral each have lubrication chamfers formed on outer edges of the windings of the displacement and stationary spirals.

4. The scroll compressor as claimed in claim 1, wherein lubrication chamfers are formed in corners of the windings adjacent a sealing surface of the movable displacement spiral.

5. The scroll compressor as claimed in claim 1, wherein lubrication chamfers are formed in corners of the windings adjacent a sealing surface of the stationary spiral.

6. The scroll compressor as claimed in claim 1, further comprising an accommodating space and a suction side space respectively disposed within the housing, the accommodating space having a location within the housing different from the suction side space and is closed off within the housing from fluid communication therewith, wherein the eccentric bearing is at least partially disposed within the accommodation space and is fluidly connected to the pressure chamber, and wherein a rear wall of the movable displacement spiral that faces toward the suction side space can be acted on with a surface pressure.

7. The scroll compressor as claimed in claim 1, wherein the distance between the central point of the stationary spiral and the central point of the movable displacement spiral is at most 1.5 mm.

8. The scroll compressor as claimed in claim 1, wherein the stationary spiral has a winding angle of 6600 to 7200.

9. The scroll compressor as claimed in claim 1, wherein a volume of the pressure chamber is greater by a factor of 5-7 than a volume of fluid drawn into the movable displacement spiral per each revolution of the movable displacement spiral, and wherein the pressure chamber is thermally insulated.

10. A vehicle air conditioning system that uses $CO_2$ as a refrigerant, the system comprising:

a scroll compressor including:

a housing;

a stationary spiral disposed within the housing and including first windings;

a movable displacement spiral disposed within the housing and defining a central recess, the movable displacement spiral including second windings and engaging with the stationary spiral to form a displacement chamber defined between the stationary spiral and the movable displacement spiral, wherein the first and second windings are interleaved to define a plurality of sub-chambers within the displacement chamber that compress refrigerant and discharge refrigerant into a pressure chamber when the movable spiral orbits relative to the stationary spiral;

a bearing bushing formed with the movable displacement spiral and extending into the displacement chamber such that a base of the bushing is coplanar with a face side of the second windings;

an eccentric bearing including a journal disposed within the bearing bushing and configured to orbit the movable displacement spiral; and a counterweight at least partially accommodated within the central recess and connected to the eccentric bearing.

* * * * *